US007490979B2

(12) United States Patent
Hiranuma et al.

(10) Patent No.: US 7,490,979 B2
(45) Date of Patent: Feb. 17, 2009

(54) TIMEPIECE

(75) Inventors: Haruki Hiranuma, Chiba (JP); Kinshuro Itoh, Chiba (JP); Yoshio Hozumi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/900,435

(22) Filed: Sep. 12, 2007

(65) Prior Publication Data

US 2008/0068935 A1 Mar. 20, 2008

(51) Int. Cl.
*G04B 37/00* (2006.01)
*G04B 39/00* (2006.01)

(52) U.S. Cl. ..... 368/295

(58) Field of Classification Search ..... 368/77, 368/88, 223, 228, 233, 294–296
See application file for complete search history.

(56) References Cited

U.S. PATENT DOCUMENTS

| | | | | |
|---|---|---|---|---|
| 3,271,945 | A * | 9/1966 | Anderson | 368/22 |
| 5,319,617 | A * | 6/1994 | Sonoda | 368/294 |
| 6,599,009 | B2 * | 7/2003 | Terasawa et al. | 368/295 |
| 7,072,247 | B2 * | 7/2006 | Hiranuma et al. | 368/88 |
| 2003/0099165 | A1 * | 5/2003 | Terasawa | 368/294 |
| 2003/0123332 | A1 * | 7/2003 | Hiranuma et al. | 368/295 |
| 2005/0141347 | A1 * | 6/2005 | Takeda | 368/295 |
| 2005/0254353 | A1 * | 11/2005 | Cogoli et al. | 368/281 |

FOREIGN PATENT DOCUMENTS

| | | |
|---|---|---|
| JP | 0592779 | 12/1993 |
| JP | 2003270365 | 9/2003 |

* cited by examiner

*Primary Examiner*—Vit W Miska
(74) *Attorney, Agent, or Firm*—Adams & Wilks

(57) ABSTRACT

To provide a timepiece in which a position alignment of a bezel is easy, and a position-aligned bezel can be made so as not to be carelessly rotated. A portable timepiece possesses a case band, an annular bezel, a click member, a coil spring, and a lock member. In the case band, there are provided an annular bezel disposition groove opening upward and to an outer periphery face, and an accommodation hole extending in a vertical direction while opening to a bottom face of this groove. Bezel is disposed, while being fitted to the disposition groove, so as to be rotatable in both directions of a clockwise direction and a counterclockwise direction in regard to the case band. A click member engaging with and disengaging from an engagement part comprising plural irregularities juxtaposed in a rotation direction in a back face of the bezel facing on the bottom face is accommodated in the accommodation hole so as to be vertically movable. In the accommodation hole, there are accommodated the spring pushing the click member to the engagement part, and the lock member. The lock member moves between a retention position retaining the click member to a state in which this member engages with the engagement part and a retracted position allowing a click operation of the click member, by an operation from an outside of the case band.

12 Claims, 6 Drawing Sheets

TIMEPIECE

BACKGROUND OF THE INVENTION

1. Field of the Invention

The present invention is concerned with a timepiece used while being carried like a wristwatch, a pocket watch or the like, and relates especially to a timepiece possessing a rotatable bezel.

2. Description of the Related Art

Hitherto, the bezel rotatably disposed in a case band is made so as to be retained in a desired operative position by a constitution giving a click feeling following upon its rotation operation. As a constitution for it, there are known a click ball type and a leaf spring type.

The click ball type possesses a constitution in which, in a back face of the bezel, there is provided a click groove formed with engagement teeth comprising plural irregularities juxtaposed in a rotation direction of this bezel and, in the case band, there are provided a steel ball engaged with and disengaged from the engagement teeth, and a coil spring pushing this steel ball to the engagement teeth. In this constitution, if the bezel is arbitrarily rotated in any direction of a clockwise direction and a counterclockwise direction, since the coil spring deforms with the steel ball being pushed to the engagement teeth, a rotation of the bezel is allowed. And, every time the bezel rotates by a constant angle, since the steel ball enters between the engagement teeth of the click groove due to a force of the coil spring, the click feeling is given each time. Together with this, by the fact that, in a rotation position at a time point in which a rotation force of the bezel is vanished, the steel ball enters between the engagement teeth of the click groove, the bezel can be retained to a desired rotation position (e.g., refer to JP-A-2003-270365 Gazette (paragraphs 0002-0009, FIG. 3)).

Further, in the leaf spring type, in the back face of the bezel, there is provided the click groove comprising plural irregularities juxtaposed in the rotation direction of this bezel, a leaf spring facing on the click groove is mounted to the case band, and an elastic part cut and stood from this leaf spring is engaged with the click groove. A sectional shape of the click groove forms a shape having a stopper face in a direction perpendicular to the rotation direction of the bezel, in other words, a rectangular shape or a right triangle shape. By this, in a case where the bezel is rotated in one direction previously determined, it is possible to give the click feeling every time the bezel rotates by the constant angle with the elastic part being removed from the click groove. Further, in a case where the bezel is rotated in a direction reversed to the former direction, there is made such that a tip of the elastic part is caught to the stopper face and engaged with the click groove such that the bezel does not rotate reversely (e.g., refer to JP-UM-A-5-92779 Gazette (paragraphs 0007-0010, FIG. 1-FIG. 3)).

In the conventional example of the above click ball type, although the bezel can be rotated in any direction of the clockwise direction and the counterclockwise direction, since a retention of the bezel to the desired rotation position depends only on a force of the coil spring, a reliability for retaining the bezel to the desired rotation position is low. Therefore, there is the fact that the bezel is carelessly rotated by an external force acting on the bezel at a carrying time of the timepiece.

Further, in the conventional example of the leaf spring type, since the rotation of the bezel is regulated to only one direction, in a case where the bezel is rotation-operated while slightly deviating from the desired rotation position due to a wrong operation, it is impossible to reversely rotate the bezel. Therefore, the bezel must be aligned with the desired rotation position by being rotated again by approximately one rotation, so that time and effort are required. Not only it, in a case where, at a carrying time of the timepiece, an external force acts in a direction along which the rotation of the bezel is allowed, there is also a fear that the bezel is carelessly rotated.

SUMMARY OF THE INVENTION

It is an aspect of the present invention to provide a timepiece in which a position alignment of the bezel is easy, and the position-aligned bezel can be made so as not to be carelessly rotated.

The present invention possesses a case band in which there are formed an annular bezel disposition groove opening upward and to its outer periphery face, and an accommodation hole vertically extending while opening to a bottom face of the disposition groove; an annular bezel which is disposed, while being fitted to the bezel disposition groove, so as to be rotatable in both directions of a clockwise direction and a counterclockwise direction in regard to the case band, and in which there is formed, in a back face facing on the bottom face of the bezel disposition groove, an engagement part comprising plural irregularities juxtaposed in the rotation direction; a click member engaging with and disengaging from the engagement part while being accommodated in the accommodation hole so as to be vertically movable; a biasing body pushing the click member to the engagement part while being accommodated in the accommodation hole; and a lock member accommodated in the accommodation hole so as to be vertically movable by an operation from an outside of the case band, and moved between a retention position retaining the click member to a state in which the click member engages with the engagement part and a retracted position allowing a click operation of the click member by releasing the retention.

In the present invention, by the fact that the lock member is moved to the retracted position, a restriction of the click member is released. Under this released state, it becomes possible to rotation-operate the click member. When the bezel is rotated, since the click member is vertically moved by a quantity approximately corresponding to a height of a convex of the engagement part by the convex of the engagement part of the bezel and a force of the biasing body to thereby carry out a click operation engaging with and disengaging from a concave of the engagement part of the bezel, it is possible to give the click feeling each time by the click member. Together with this, since a rotation direction of the bezel is not limited to one direction, in a case where a rotation of the bezel is performed excessively, it is possible to easily align the bezel to a predetermined position by being reversely rotation-operated without requiring, an effort for rotating by approximately one rotation again.

And, after the bezel is position-aligned, by moving the lock member to the retention position, the click member engaging with the concave of the engagement part butts against or approaches to the lock member, and is retained to a state in which the click member can not be removed from the engagement part, in other words, a state in which the click member is locked. Since this locked state can be maintained unless it is artificially released, even if there is the fact that an external force attempting to rotate the bezel acts on it during the timepiece is carried, the position-aligned bezel can be retained so as not to be rotated carelessly.

In a desirable mode of the present invention, a manual operation type operation member moving the lock member between the retention position and the retracted position is connected to the lock member, and this operation member is provided so as to be capable of being operated from the outside of the case band.

In the mode of this invention, since the lock member can be moved by directly contacting a user's finger tip to the operation member to thereby operate this operation member, the lock member can be simply, selectively moved to the retention position or the retracted position without requiring any tool, and it is excellent in handling ability.

In a desirable mode of the present invention, the accommodation hole is formed by a large diameter hole part and a small diameter hole part continuing below the large diameter hole part, and a concave groove opening to the outer periphery face of the case band is provided in the case band while intersecting perpendicularly to the small diameter hole part; the operation member is formed by a disc-like dial having a female thread part in its center part, and a movement of this operation member in a vertical direction is regulated by the concave groove and the operation member is rotatably disposed in the concave groove by protruding one part of the operation member to the outside of the case band; and a rotation-stop member having a central square hole is accommodated in the large diameter hole part while being fixed to a step part forming a boundary between the large diameter hole part and the small diameter hole part, and the lock member is formed by a square axle part contacting with and separating from the click member while penetrating through the central square hole, and a thread axle part having a male thread part meshing with the female thread part while being continued to a downside of the square axle part.

In the mode of this invention, since the lock member is rotation-stopped by the rotation-stop member, if the operation member comprising the dial is rotation-operated, the lock member is moved in an upward direction or a downward direction in compliance with the rotation direction of the operation member by a mesh between the female thread part of this operation member and the male thread part of the lock member. By moving the lock member in the upward direction (front direction of the timepiece), this lock member can be disposed in a lock position and, reversely to this by moving the lock member in the downward direction (back face direction of the timepiece), this lock member can be disposed in the retracted position. And, since the operation member can be operated in an outside face of the case band, the operation member can be simply operated by a hand finger without requiring the tool. Therefore, according to the mode of this invention, it is possible to perform a vertical movement operation of the lock member and a rotation operation of the bezel under a state in which the bezel is directed to the front.

In a desirable mode of the present invention, the click member is formed by a slide part which is guided in the accommodation hole and whose outer periphery is a circular shape, and a hemispherical part fitted to a concave of an engagement part formed monolithically in an upside of the slide part.

In the mode of this invention, it is possible to stabilize a movement of the click member by sliding the click member in the accommodation hole of the case band and, since the hemispherical part of the click member is engaged with and disengaged from the engagement part of the bezel, an engagement/disengagement operation of the click member in regard to the irregularities of the engagement part when giving the click feeling is smooth.

In a desirable mode of the present invention, a stopper, which, when the lock member is moved to the retracted position, hampers a movement of the lock member more than it, is provided in the case band.

In the mode of this invention, by the fact that a movement of the lock member is hampered by the stopper, the fact that the lock member is moved to the retracted position can be sensed, and a time at which the bezel is rotation-operated can be understood.

According to the present invention, it is possible to provide a timepiece in which, by releasing the lock state of the click member, the position alignment of the bezel can be easily performed and, by making the click member into the lock state, the position-aligned bezel can be retained so as not to be carelessly rotated.

DESCRIPTION OF THE PREFERRED EMBODIMENTS

Hereunder, one embodiment of the present invention is explained by referring to FIG. 1-FIG. 8.

Figure 1:
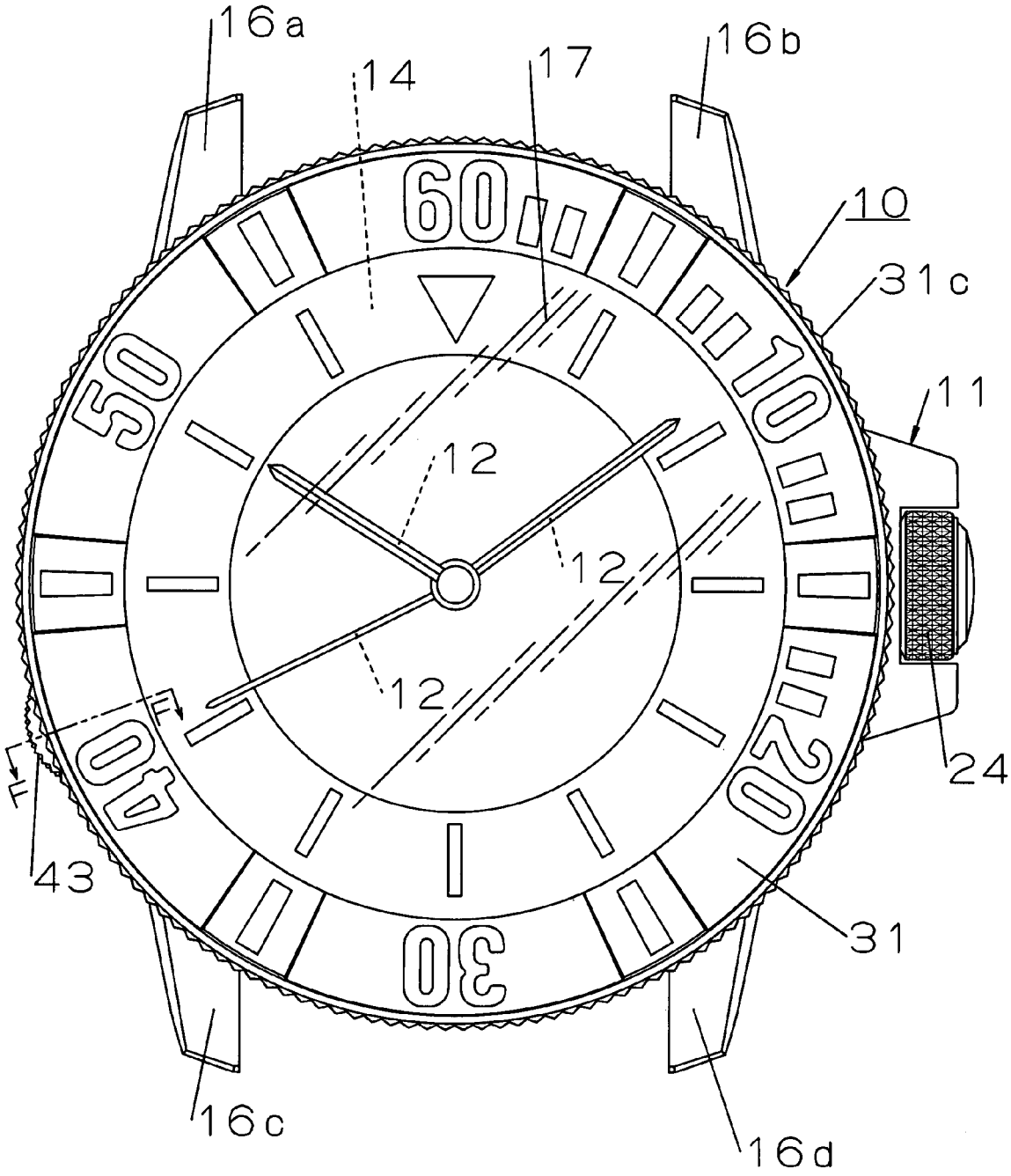
FIG. 1 is a front view showing a portable timepiece concerned with one embodiment of the present invention.

In FIG. 1, a reference numeral 10 denotes a portable timepiece used while being worn to an arm for instance. In a timepiece armor assembly 11 that this portable timepiece 10 possesses, there are accommodated a timepiece movement 13 (shown in FIG. 3 and FIG. 4) driving indication hands 12, a dial 14 attached to this timepiece movement 13, a frame-like member 15 (shown in FIG. 3 and FIG. 4) retaining the timepiece movement 13 to the timepiece armor assembly 11, and the like.

As shown in FIG. 1-FIG. 4, the timepiece armor assembly 11 possesses a case band 16 which is desirably made of a metal and annularly made, a cover glass 17 is fluid-tightly mounted to one face (front face) in a thickness direction of the case band 16, and a case back 18 is formed in the other face (back face) in the thickness direction of the case band 16 while being detachably meshed. The indication hands 12 and the dial 14 are visible through the cover glass 17. Incidentally, in FIG. 3 and FIG. 4, a reference numeral 19 denotes an annular waterproof gasket such as O-ring having elasticity.

Figure 3:
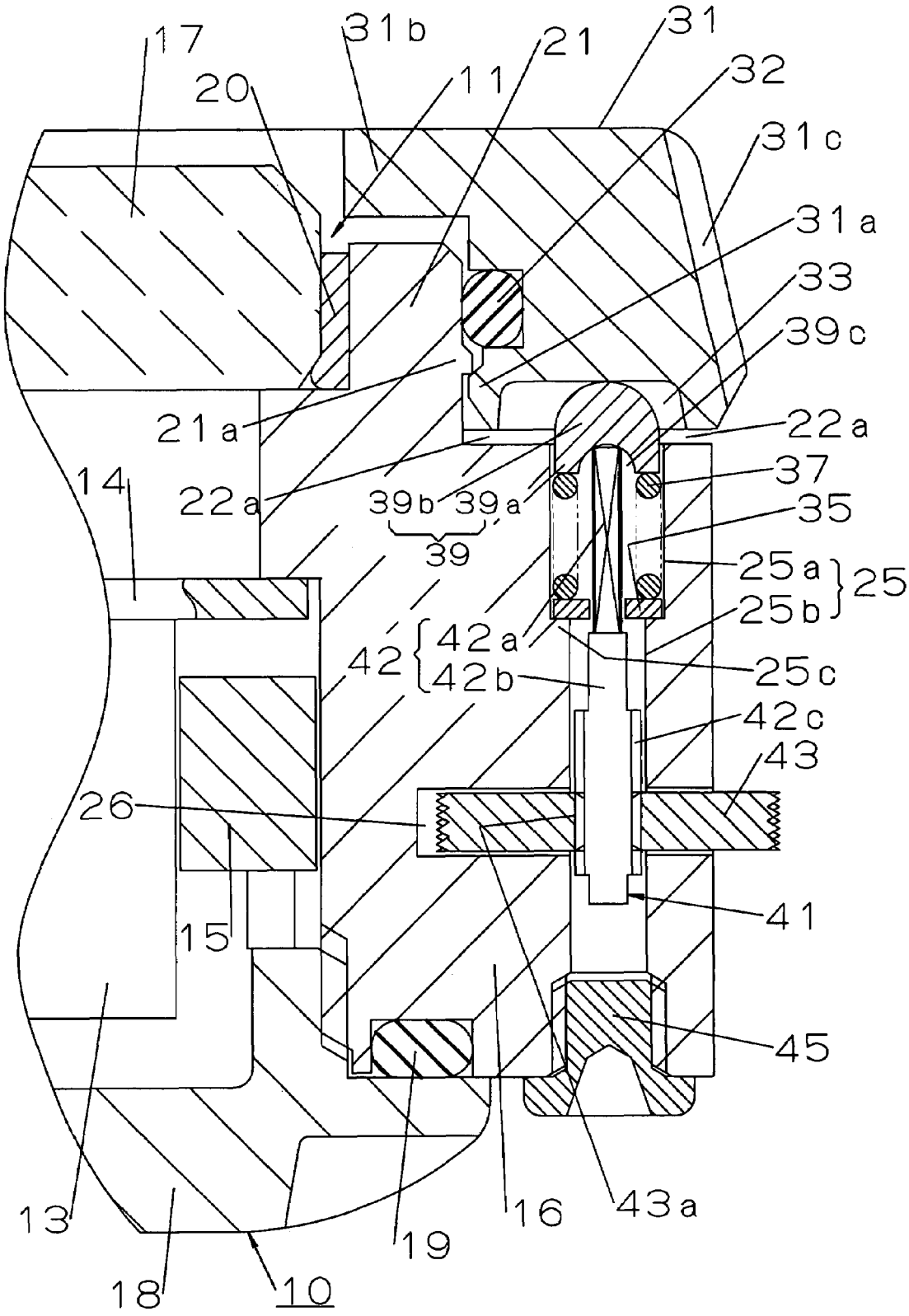
FIG. 3 is a sectional view showing, along an F-F line in FIG. 1, a state in which there is locked a rotation of a bezel that the portable timepiece of FIG. 1 possesses.
Figure 4:
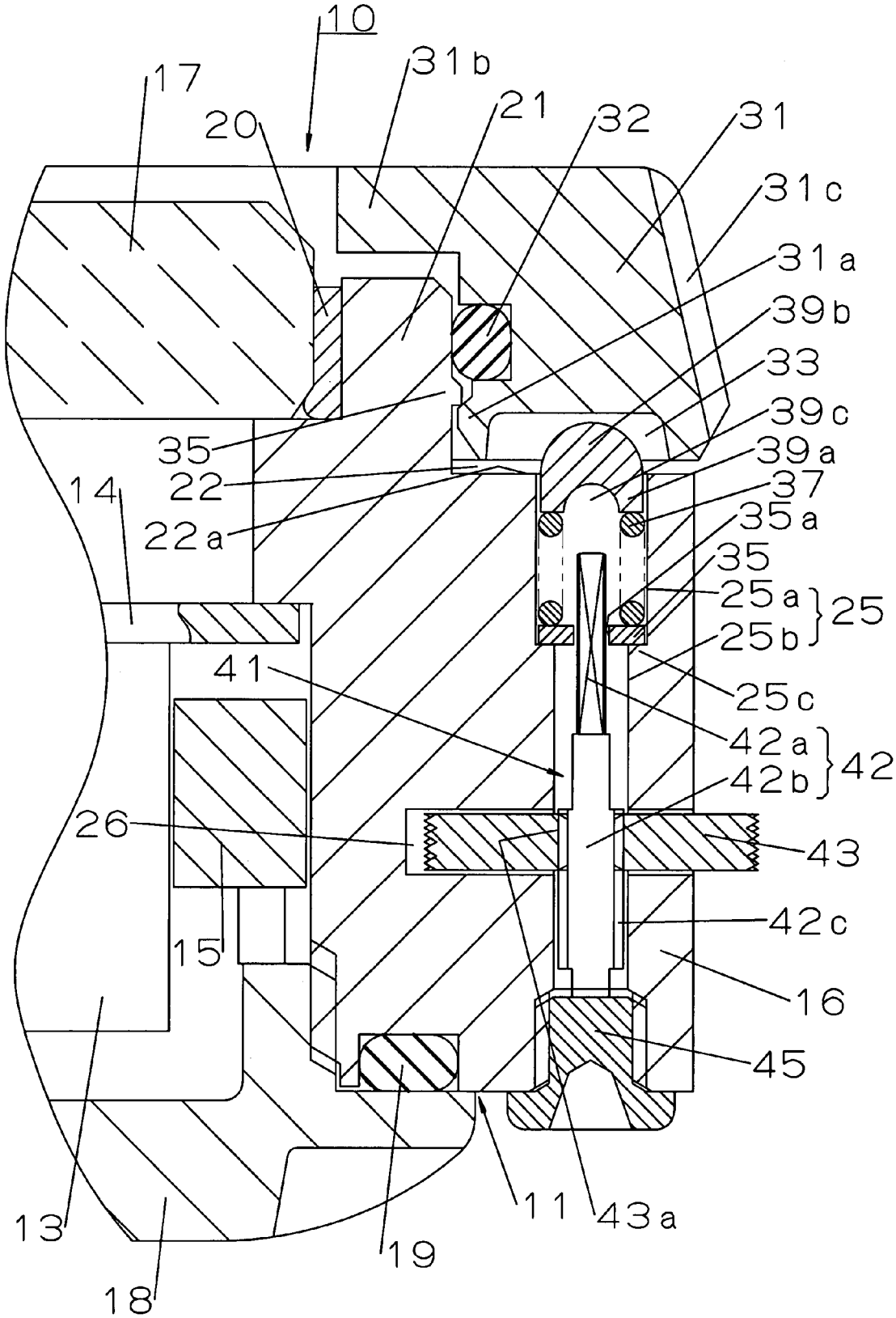
FIG. 4 is a sectional view showing, along the F-F line in FIG. 1, a state in which there is released the lock of the rotation of the bezel that the portable timepiece of FIG. 1 possesses.

As shown in FIG. 3 and FIG. 4, in an end part of a front face (upper face) side of the case band 16, there is monolithically provided an annular convex part 21 protruding in a front face direction, and there is provided an annular bezel disposition groove 22. The cover glass 17 is mounted to an inner periphery of the annular convex part 21 through a ring-shaped gasket 20. In an outer periphery of the annular convex part 21, an annular engagement convex part 21*a* continuing in a circumferential direction of the annular convex part is provided in the bezel disposition groove 22 while protruding. The bezel disposition groove 22 is opened upward and to an outer periphery face of the case band 16, and surrounds the annular convex part 21. A bottom face 22*a* of the bezel disposition groove 22 is placed in a downside than the engagement convex part 21*a*, and runs to a root of the annular convex part 21 at a right angle.

Figure 2:
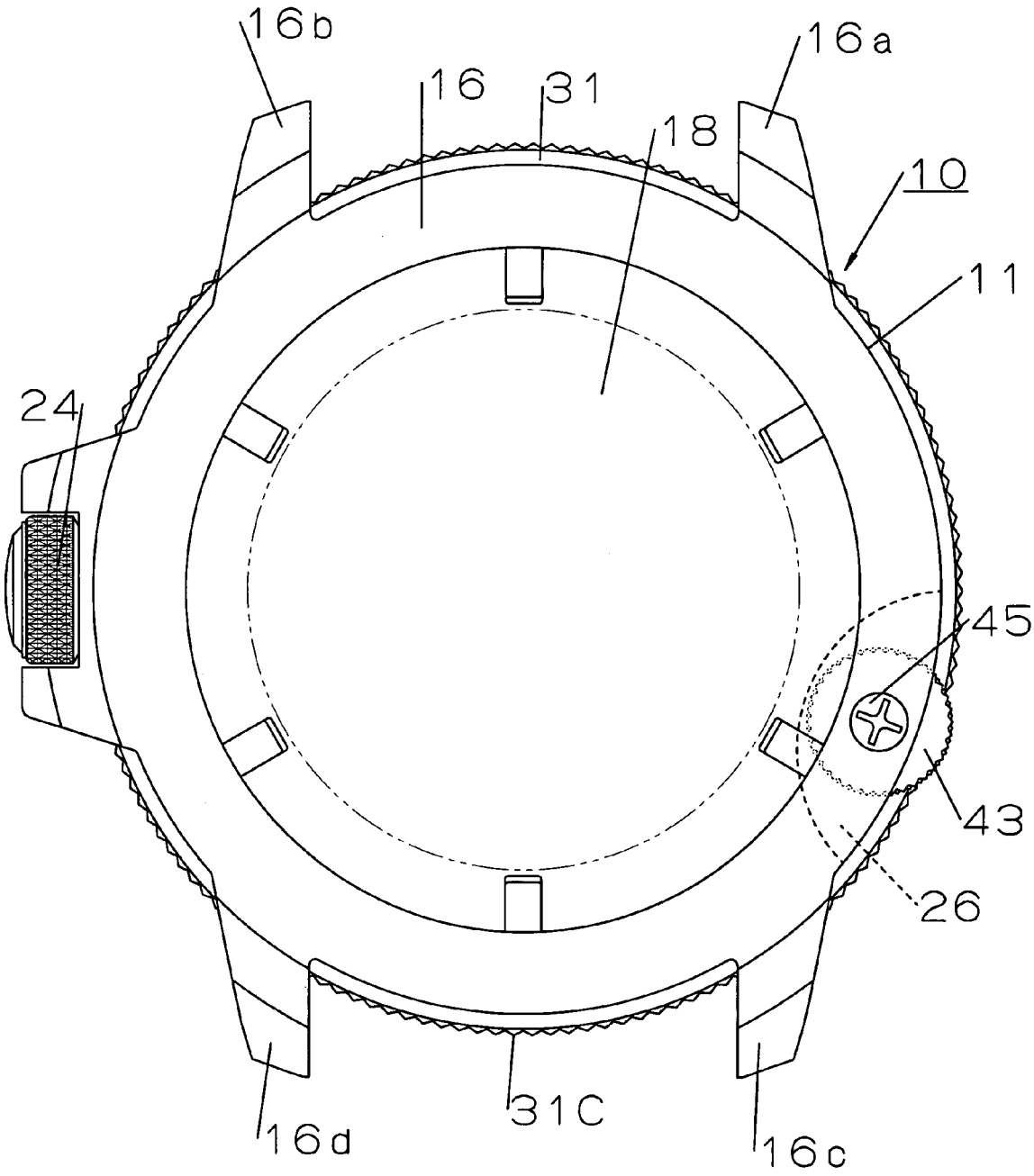
FIG. 2 is a back view showing the portable timepiece of FIG. 1.

In FIG. 1 and FIG. 2, a reference numeral 24 denotes a crown for operating a winding stem not shown in the drawing. As shown in FIG. 3 and FIG. 4, in the case band 16, there are formed an accommodation hole 25 and a concave groove 26. The accommodation hole 25 and the concave groove 26 are provided while separating from the crown 24 by, e.g., approximately 180° while being placed, among four attachment convex parts 16*a*-16*d* (refer to FIG. 1 and FIG. 2) to which there is connected an arm wear member, such as band or belt, not shown in the drawing, between the two attachment convex parts 16*a*, 16*c* placed in a remote side in regard to the crown 24.

As shown in FIG. 3 and FIG. 4, the accommodation hole 25 extends in the thickness direction of the case band 16, in other words, a vertical direction, and comprises a large diameter hole part 25*a* and a small diameter hole part 25*b*, both of which form a circular shape for instance. An upper end of the large diameter hole part 25*a* is opened to the bottom face 22*a* of the bezel disposition groove 22. An upper end of the small diameter hole part 25*b* continues to a lower end of the large diameter hole part 25*a*, and a step part 25*c* is formed between the large diameter hole part 25*a* and the small diameter hole part 25*b*. A lower end of the small diameter hole part 25*b* is opened to the back face of the case band 16, and a thread groove is formed in this lower end part.

As shown in FIG. 2, the concave groove 26 is, e.g., a semicircular shape when viewed in a plane, and intersects perpendicularly to the small diameter hole part 25*b* as shown in FIG. 3 and FIG. 4 and is opened to an outer surface of the case band 16.

The timepiece armor assembly 11 possesses a bezel 31 provided so as to surround the dial 14. The bezel 31 is annularly made by a metal or a synthetic resin etc., and disposed so as to be rotatable in regard to the case band 16 in both directions of the clockwise direction and the counterclockwise direction while being fitted to the bezel disposition groove 22. An annular inner periphery convex part 31*a* that the bezel 31 has is caught to the engagement convex part 21*a* from its downside and, by it, the bezel 31 is retained so as not to be removed. The bezel 31 has a cover part 31*b* facing on an upper end face of the annular convex part 21. Together with this, in the bezel 31, there are provided, in its outer periphery face, plural or many irregularities 31*c* for making such that a finger does not slip when rotating it. Incidentally, in FIG. 3 and FIG. 4, a reference numeral 32 is a bezel gasket comprising an O-ring or the like, which has elasticity and is used in its compressed state and, by this bezel gasket 32, a backlash of the bezel 31 is prevented.

In a back face, of the bezel 31, facing on the bottom face 22*a* of the bezel disposition groove 22, there is provided an engagement part 33. This engagement part 33 is formed by, e.g., plural irregularities continuously juxtaposed in a direction along which the bezel 31 rotates. The respective irregularities forming the engagement part 33 extend all in a radial direction in regard to a center of the bezel 31. The number of the irregularities is 60 or 120. A downward, convex section of the engagement part 33 in a case where the engagement part 33 is sectioned along a circumferential direction of the bezel 31, and a section of a concave of the engagement part 33 opening to the back face of the bezel 31 form all an approximately triangular shape.

Figure 7A:
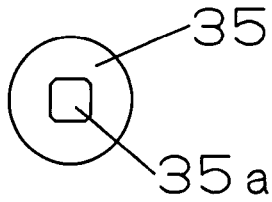
FIG. 7A is a plan view showing a rotation-stop member that the portable timepiece of FIG. 1 possesses.
Figure 7B:
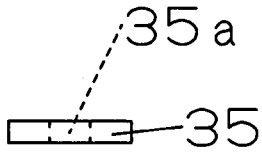
FIG. 7B is a side view showing the rotation-stop member.

A rotation-stop member 35 is accommodated in the large diameter hole part 25*a*, and fixed onto the step part 25*c*. This fixation is performed by using an adhesive or the like, pressing-in the rotation-stop member 35 to the large diameter hole part 25*a*, or the like. By it, the rotation-stop member 35 is provided such that itself does not rotate freely in the large diameter hole part 25*a*. As shown in FIGS. 7A and 7B, the rotation-stop member 35 is formed by a washer having in its center part a central square hole 35*a* of a quadrangular shape for instance.

Figure 8A:
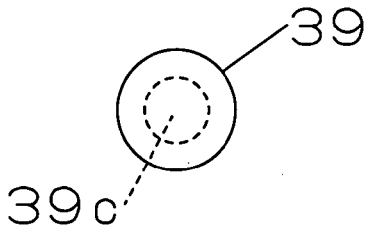
FIG. 8A is a plan view showing a click member that the portable timepiece of FIG. 1 possesses.
Figure 8B:
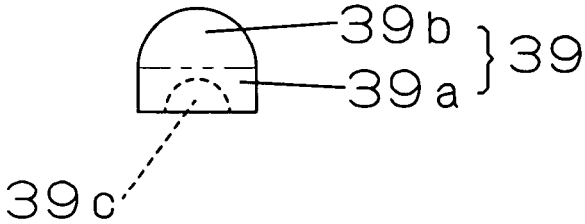
FIG. 8B is a side view showing the click member.

In the large diameter hole part 25*a*, there is accommodated, e.g., a coil spring 37 as a biasing body having in its center part an inner hollow part penetrating in the vertical direction. A lower end of this coil spring 37 is supported by the rotation-stop member 35. The coil spring 37 supports in its upper end a click member 39 made of a metal for instance. As shown in FIGS. 8A and 8B, the click member 39 comprises a slide part 39*a* forming its lower part, and a hemispherical part 39*b* forming its upper part. An outer periphery of the slide part 39*a* is a circular shape. In the slide part 39*a*, there is formed a reception concave part 39*c* opened to its lower face (back face). The hemispherical part 39*b* is formed in such a size that the hemispherical part 39*b* is fitted into the convex section of the engagement part 33.

The slide part 39*a* of the click member 39 is vertically, movably accommodated in an upper part of the large diameter hole part 25*a* so as to be guided in this large diameter hole part 25*a*. The hemispherical part 39*b* of the click member 39 is protruded from the large diameter hole part 25*a*. Following upon an attachment of this click member 39, the coil spring 37 is retained in its compressed state and, by it, the coil spring 37 biases upward the click member 39 to thereby push to the engagement part 33.

To the case band 16, there is attached a lock mechanism 41 retaining the click member 39 so as not to move except a rotation operation time of the bezel 31, and allowing a movement of the click member 39 at the rotation operation time of the bezel 31. The lock mechanism 41 comprises a lock member 42, and an operation member 43 connected to this lock member 42.

Figure 5A:
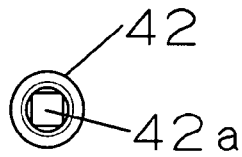
FIG. 5A is a plan view showing a lock member that the portable timepiece of FIG. 1 possesses.
Figure 5B:
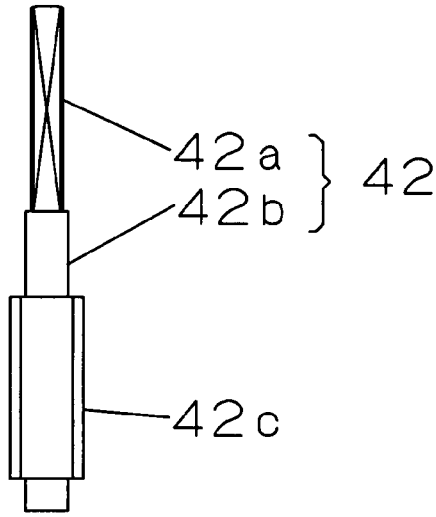
FIG. 5B is a side view showing the lock member.

The lock member 42 is accommodated in the accommodation hole 25 so as to be vertically movable. The lock member 42 comprises a square axle part 42*a*, and a thread axle part 42*b* monolithically continued to a downside of this square axle part 42*a*. As shown in FIGS. 5A and 5B, the square axle part 42*a* is the same shape as the central square hole 35*a* of the rotation-stop member 35, and there is made such that it is penetrated to the central square hole 35*a* and inserted to the inner hollow part of the coil spring 37, and its tip (upper end) is inserted to and retreated from the reception concave part 39*c* of the click member 39. The thread axle part 42*b* is a columnar shape in its upper and lower both-end parts, and has a male thread part 42*c* in an outer periphery of a site between the both-end parts. Accordingly, the upper and lower both-end parts of the thread axle part 42*b* are fine in comparison with an outer diameter of the male thread part 42*c*, and further the upper and lower both-end parts are formed thicker than the square axle part 42*a*.

Figure 6A:
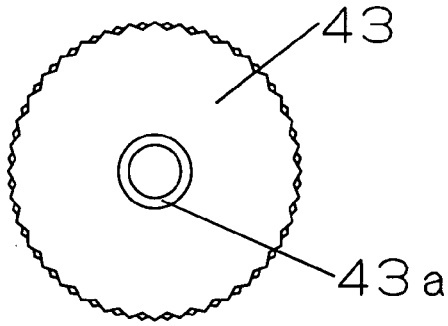
FIG. 6A is a plan view showing an operation member that the portable timepiece of FIG. 1 possesses.
Figure 6B:
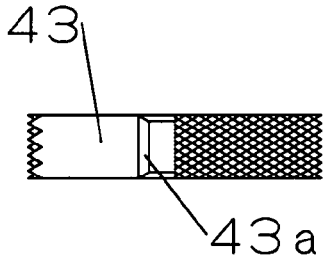
FIG. 6B is a side view showing the operation member with its one part being sectioned.

As shown in FIGS. 6A and 6B, the operation member 43 comprises a disc-like dial. The operation member 43 has in its center part a female thread part 43*a*, and its outer periphery face becomes a knurled face to which there is applied a knurl working for suppressing a hand finger from slipping when this operation member 43 is manually rotated.

The operation member 43 is rotatably accommodated in the concave groove 26 with its one part being protruded from an outer periphery face of the case band 16. Under this state, a vertical direction movement of the operation member 43 is regulated by upper and lower groove side faces of the concave groove 26. The female thread part 43*a* of this operation member 43 is meshed with the male thread part 42*c*, and the lock member 42 is passed to a center part of the operation member 43.

A stopper 45 detachable from the back face of the case band 16 is screwed to the small diameter hole part 25*b* of the accommodation hole 25. By this stopper 45, the accommodation hole 25 is closed.

Next, procedures for assembling surroundings of the lock mechanism 41 are explained. First, a lower end part of the accommodation hole 25 is closed by screwing the stopper 45 to the case band 16. Next, after the operation member 43 is accommodated to the concave groove 26 of the case band 16, the lock member 42 is accommodated to the accommodation hole 25 from above the accommodation hole 25 with the thread axle part 42*b* of the lock member 42 being made a top, and the thread axle part 42*b* of this lock member 42 is meshed with the female thread part 43*a* of the operation member 43. By this, it follows that the lock member 42 is supported to the operation member 43 and the operation member 43 is not removed from the concave groove 26.

After this, the rotation-stop member 35 is accommodated to the large diameter hole part 25*a* of the accommodation hole 25 while fitting the central square hole 35*a* of the rotation-stop member 35 to the square axle part 42*a* of the lock member 42, and this rotation-stop member 35 is fixed onto the step part 25*c*. By this, the lock member 42 is rotation-stopped by the rotation-stop member 35. Next, by rotating the operation member 43 in a direction along which the lock member 42 sinks into the accommodation hole 25, the lock member 42 is descended, thereby butting a lower end of this lock member 42 against the stopper 45. Also under this state, the square axle part 42*a* penetrates through the central square hole 35*a* of the rotation-stop member 35. After this, after the coil spring 37 is accommodated to the large diameter hole part 25*a*, the click member 39 is disposed in the large diameter part 25*a* so as to be mounted onto this coil spring 37.

Next, by fitting the bezel 31, to which the bezel gasket 32 is already attached, to the bezel disposition groove 22 of the case band 16, the inner periphery convex part 31*a* of this bezel 31 is caught to the engagement convex part 21*a* of the case band 16. By it, the bezel 31 is disposed so as to be rotatable in regard to the case band 16. Following upon this attachment of the bezel 31, the coil spring 37 is deformed to its compressed state through the clock member 39. Therefore, the click member 39 is pushed to the engagement part 33 of the bezel 31 by a biasing force of the coil spring 37.

Finally, after there is confirmed the fact that the rotation of the bezel 31 and the click feeling following upon it are being suitably obtained, the lock member 42 is ascended in a bezel 31 direction by rotating the operation member 43 in a direction reverse to the direction mentioned before. By it, an upper end part of the square axle part 42*a* of the lock member 42 enters, as a desirable example, to the reception concave part 39*c* of the click member 39 to thereby butt against the click member 39, and this click member 39 is nipped between the bezel 31 and the lock member 42.

An assembly completion state of the above is shown in FIG. 3. According to the above procedures of the assembly, since the assembling of the bezel 31 is performed under a retracted state in which the lock member 42 is once positioned by the stopper 45, there is no fact that an assembling force of the bezel 31 acts on the lock member 42 through the click member 39. Therefore, there is no fact that there is brought about such a defect that the mesh parts of the square axle part 42*a*, the female thread part 43*a* and the male thread part 42*c* undergo an excessive force and thus deform, and there can be assembled by elastically deforming the coil spring 37 in a direction along which it is compressed.

In a case where the bezel 31 is rotation-operated from the assembly completion state shown in FIG. 3, there suffices if it is performed by the following procedures.

First, by rotation-operating the operation member 43, the lock member 42 is descended through a mesh between the female thread part 43*a* and the male thread part 42*c*. In this case, the lock member 42 is descended till the lower end of the lock member 42 butts against the stopper 45. By the fact that the movement of the lock member 42 is hampered by the stopper 45 in this manner, it is possible to sense the fact that the lock member 42 was moved to a retracted position. In other words, there can be sensed the fact that the lock mechanism 41 becomes a lock release state, and the rotation of the bezel 31 becomes so as to be allowed. By this, it is possible to know a time at which the rotation operation of the operation member 43 ends, and a time at which the rotation operation of the bezel 31 becomes possible.

After this, the bezel 31 is rotation-operated by a desired angle. By it, as a relative position between the engagement part 33 in the back face of the bezel 31 and the click member 39 supported to the case band 16 changes, after the click member 39 is pushed down by a downward convex of the engagement part 33 while resisting against the coil spring 37, there becomes an engagement state in which the click member 39 enters to a concave, of the engagement part 33, adjoining this convex by a force of the coil spring 37. Therefore, every time the bezel 31 is rotated by a constant angle, the click feeling is obtained. And, at a time point in which the rotation operation of the bezel 31 is stopped, since there becomes the engagement state in which the click member 39 enters to the concave of the engagement part 33, the bezel 31 is stopped at a desired rotation position.

In the case of the above click operation, since the slide part 39*a* of the click member 39 is guided in the large diameter hole part 25*a* of the accommodation hole 25 of the case band 16, it is possible to stabilize a vertical motion of the click member 39. Together with this, since the hemispherical part 39*b* of the click member 39 engages with and disengages from the concave of the engagement part 33 of the bezel 31, there is no fear that, when giving the click feeling, the click member 39 is caught to the concave/convex of the engagement part 33 and the rotation operation of the bezel 31 is hindered, so that the click operation in which the click member 39 engages and disengages in regard to the bezel 31 can be smoothly performed.

Further, as mentioned already, by the fact that, following upon the rotation of the bezel 31, the click member 39 descends while resisting against the coil spring 37, there is allowed a passing of the downward convex of the engagement part 33 in regard to an upper end of the click member 39. Therefore, the click member 39 is not one impeding the clockwise or counterclockwise rotation of the bezel 31, so that the bezel 31 can be rotated in any direction. Accordingly, in a case where there is made the wrong operation somewhat, excessively going than the desired rotation position by the rotation in one direction, it is possible to easily correct such that the bezel 31 is stopped at the desired rotation position by reversely rotating the bezel 31 in compliance with a quantity of the excessive going from that position.

After the bezel 31 is rotation-operated by the desired angle, by rotation-operating again the operation member 43 in the direction reverse to the case of the lock release, the lock member 42 is ascended through the mesh between the female thread part 43*a* and the male thread part 42*c*. By it, the lock member 42 penetrates through the coil spring 37 in an axial direction, and an upper end of this lock member 42 butts against a back face of the click member 39, concretely, the reception concave part 39*c*. Accordingly, since the click member 39 is pushed up by the lock member 42 and nipped between this lock member 42 and the engagement part 33 of the bezel 31, it is possible to sense the fact that an ascend of the lock member 42 is hampered and this lock member 42 is moved to a lock position, and it is possible to know the time at which the rotation operation of the operation member 43 ends.

Under this state, as shown in FIG. 4, the lock member 42 of the lock mechanism 41 becomes a stopper, so that the click member 39 is hampered from moving downward. Therefore, after this time point, even if an external force attempting to rotate the bezel 31 acts on it following upon the fact that the portable timepiece 10 is carried, the bezel 31 position-aligned with the desired rotation position can be retained so as not to be carelessly rotated.

Further, as already mentioned, since the operation member 43 of the lock mechanism 41 comprises the dial in which its one part is protruded to the outer periphery face of the case band 16, the operation member 43 can be simply operated by the hand finger without requiring a tool in an outside face of the case band 16. Therefore, an operability is good because the operation of the lock mechanism 41 and the rotation operation of the bezel 31 can be performed while having the portable timepiece 10 under a state in which the bezel 31 is directed to a front without requiring a troublesome effort for shifting the portable timepiece 10 from one hand to the other with its front and back being reversed.

In the above one embodiment, since a rotation regulation of the lock member 42 comprising an axle is performed by using the rotation-stop member 35 having the central square 35*a*, the accommodation hole 25 can be formed by a circular hole. Moreover, since the large diameter hole part 25*a* and the small diameter hole part 256, which form the accommodation hole 25, directly continue, a hole working for forming the accommodation hole 25 in the case band 16 can be easily performed.

Incidentally, it is also possible to perform a rotation regulation of the lock member 42 by forming, in an inner face of the small diameter part 25*b*, slots extending in the axial direction while being spaced by 180 degrees in the circumferential direction, and providing, in an outer periphery face of the lock member 42 while avoiding the male thread part 42*c*, one pair of slide convex parts slidably fitted to these slots. In this case, since a square axle part corresponding part of the lock member 42 can be made a circular axle part, besides the fact that a working of the lock member 42 becomes simple, the lower end of the coil spring 37 can be received by the step part 25*c* while omitting the rotation-stop member. Further, also in a case where, instead of the rotation-stop member, a spring receiver is provided on the step part 25*c*, the assembly becomes easy because there suffices if there is used a low cost washer having a central passing hole consisting of a circular hole, and it is also unnecessary to fix this washer to the step part 25*c*.

In the above one embodiment, since the stopper 45 is formed by a plug screwed to the case band 16, dusts or the like are difficult to enter to the accommodation hole 25 from a back side of the case band 16. Incidentally, by making the accommodation hole 25 into a hole in which a back face part monolithic with the case band 16 is made its bottom, not the penetrating hole, the back face part may be made the stopper 45. However, since the stopper 45 of a screwing type can be removed in compliance with a necessity, it is desirable in such points that, in a case where, e.g., the water enters to the accommodation hole 25, the entered water can be discharged from the accommodation hole 25 by removing the stopper 45, and that it is possible to promote a drying of this lock mechanism 41 or the like.

In the above one embodiment, although a slight interstice is provided between a back face of the bezel 31 and the bottom face 22*a*, of the bezel disposition groove 22, facing on this back face, it is also possible to cause the back face and the bottom face 22*a* to contact so as to vanish this interstice. Further, it is also possible that the bezel 31 is formed by a bezel main body to which the bezel gasket 32 is attached and which has the engagement part 33 in its back face, and the cover part 31*b* formed separately from this main body and connected to the bezel main body by a caulking fixation or the like.

Further, a constitution for locking the click member 39 is not limited to the above one embodiment. For example, it is also possible to adopt, as a lock means, a constitution, in which a female thread part is formed at least in one part of the accommodation hole 25 consisting of the penetrating hole, a lock member comprising an axle having a male thread part meshing with the female thread part is screwed from the back side of the case band 16, this lock member is advanced and retreated in an axial direction by rotating this lock member by using a tool for instance and, by it, the lock member is moved between the lock position and the retracted position.

Incidentally, the bezel may be one in which its rotation is limited to a constant angle.

What is claimed is:

1. A timepiece comprising:

a case band in which there are formed an annular bezel disposition groove opening upward and to its outer periphery face, and an accommodation hole vertically extending while opening to a bottom face of the disposition groove, an annular bezel which is disposed, while being fitted to the bezel disposition groove, so as to be rotatable in both directions of a clockwise direction and a counterclockwise direction in regard to the case band, and in which there is formed, in a back face facing on the bottom face of the bezel disposition groove, an engagement part comprising plural irregularities juxtaposed in the rotation direction, a click member engaging with and disengaging from the engagement part while being accommodated in the accommodation hole so as to be vertically movable, a biasing body pushing the click member to the engagement part while being accommodated in the accommodation hole, and a lock member accommodated in the accommodation hole so as to be vertically movable by an operation from an outside of the case band, and moved between a retention position retaining the click member to a state in which the click member engages with the engagement part and a retracted position allowing a click operation of the click member by releasing the retention.

2. A timepiece according to claim 1, wherein a manual operation type operation member moving the lock member between the retention position and the retracted position is connected to the lock member, and this operation member is provided so as to be capable of being operated from the outside of the case band.

3. A timepiece according to claim 2, wherein:

the accommodation hole is formed by a large diameter hole part and a small diameter hole part continuing below the large diameter hole part, and a concave groove opening to the outer periphery face of the case band is provided in the case band while intersecting perpendicularly to the small diameter hole part, the operation member is formed by a disc-like dial having a female thread part in its center part, and a movement of this operation member in a vertical direction is regulated by the concave groove and the operation member is rotatably disposed in the concave groove by protruding one part of the operation member to the outside of the case band, and a rotation-stop member having a central square hole is accommodated in the large diameter hole part while being fixed to a step part forming a boundary between the large diameter hole part and the small diameter hole part, and the lock member is formed by a square axle part contacting with and separating from the click member while penetrating through the central square hole, and a thread axle part having a male thread part meshing with the female thread part while being continued to a downside of the square axle part.

4. A timepiece according to claim 1, wherein the click member is formed by a slide part which is guided in the accommodation hole and whose outer periphery is a circular shape, and a hemispherical part fitted to a concave of an engagement part formed monolithically in an upside of the slide part.

5. A timepiece according to claim 2, wherein the click member is formed by a slide part which is guided in the accommodation hole and whose outer periphery is a circular shape, and a hemispherical part fitted to a concave of an engagement part formed monolithically in an upside of the slide part.

6. A timepiece according to claim 3, wherein the click member is formed by a slide part which is guided in the accommodation hole and whose outer periphery is a circular shape, and a hemispherical part fitted to a concave of an engagement part formed monolithically in an upside of the slide part.

7. A timepiece according to claim 1, wherein a stopper, which, when the lock member is moved to the retracted position, hampers a movement of the lock member more than it, is provided in the case band.

8. A timepiece according to claim 2, wherein a stopper, which, when the lock member is moved to the retracted position, hampers a movement of the lock member more than it, is provided in the case band.

9. A timepiece according to claim 3, wherein a stopper, which, when the lock member is moved to the retracted position, hampers a movement of the lock member more than it, is provided in the case band.

10. A timepiece according to claim 4, wherein a stopper, which, when the lock member is moved to the retracted position, hampers a movement of the lock member more than it, is provided in the case band.

11. A timepiece according to claim 5, wherein a stopper, which, when the lock member is moved to the retracted position, hampers a movement of the lock member more than it, is provided in the case band.

12. A timepiece according to claim 6, wherein a stopper, which, when the lock member is moved to the retracted position, hampers a movement of the lock member more than it, is provided in the case band.

* * * * *